US007980263B2

(12) United States Patent
McCarthy

(10) Patent No.: US 7,980,263 B2
(45) **Date of Patent: *Jul. 19, 2011**

(54) TRAY FOR A WALKER

(75) Inventor: Alice McCarthy, Salem, MA (US)

(73) Assignee: The Alice M. McCarthy Trust, Salem, MA (US), dated March 18, 2002

( * ) Notice: Subject to any disclaimer, the term of this patent is extended or adjusted under 35 U.S.C. 154(b) by 0 days.

This patent is subject to a terminal disclaimer.

(21) Appl. No.: 12/774,422

(22) Filed: May 5, 2010

(65) Prior Publication Data

US 2010/0212707 A1 Aug. 26, 2010

Related U.S. Application Data

(63) Continuation of application No. 11/939,824, filed on Nov. 14, 2007, now Pat. No. 7,712,477.

(51) Int. Cl.
*A61H 3/04* (2006.01)

(52) U.S. Cl. ..... 135/67; 135/66; 108/50.16; 224/407

(58) Field of Classification Search ..... 135/66–67, 135/74, 85; 108/42, 44, 49, 50.11, 50.16; 224/407, 409; 297/5–7; 482/66–68; 280/87.021, 280/250.1

See application file for complete search history.

(56) References Cited

U.S. PATENT DOCUMENTS

| | | | |
|---|---|---|---|
| 2,430,235 | A | 11/1947 | Mendenhall |
| 2,647,716 | A | 8/1953 | Hudziak et al. |
| 3,163,287 | A | 12/1964 | Barnett |
| 3,199,467 | A | 8/1965 | Compton |
| D204,998 | S | 6/1966 | Klein |
| 3,354,893 | A | 11/1967 | Schmerl |
| 3,957,071 | A | 5/1976 | Kenner |
| 4,074,683 | A | 2/1978 | Di Chiara |
| 4,212,493 | A | 7/1980 | Ledesky |
| D269,223 | S | 6/1983 | Freeman |
| 4,449,750 | A | 5/1984 | Pultman |
| 4,659,099 | A | 4/1987 | Malone |
| 4,676,416 | A | 6/1987 | Harmon |
| 4,708,274 | A | 11/1987 | Roche |
| D300,496 | S | 4/1989 | Childress |
| 4,830,243 | A | 5/1989 | Mann |
| D305,015 | S | 12/1989 | Roche |
| D308,497 | S | 6/1990 | Roche |
| D309,684 | S | 8/1990 | Kohler |

(Continued)

*Primary Examiner* — Winnie Yip
(74) *Attorney, Agent, or Firm* — Antoinette G. Giugliano, P.C.; AGG Intellectual Property Law

(57) ABSTRACT

The present invention relates to a tray for use with a walker. The tray includes a generally rigid tray base having an essentially rectangular shape with a front long side, a back long side, a first short side and a second short side, and wherein the tray has a length that extends to or past the essentially horizontal support member; a ridge extending along the sides of the tray, wherein the ridge has a height of at least about a ½ inch; a strap having a hook and loop fastener wherein the strap is positioned at or near the back long end; and a first hinge and a second hinge, the first and second hinges are positioned, when the tray is in use, at or near the front leg of the first and second support, respectively. The length of the tray is greater that the distance between the support member of the first support and the support member of the second support; and the width of the tray is less than the length of the support member of the first support or second support. The present invention further includes methods of using the tray, and system and kits that include the tray.

7 Claims, 3 Drawing Sheets

U.S. PATENT DOCUMENTS

| | | | |
|---|---|---|---|
| 4,946,058 | A | 8/1990 | Stamm |
| 5,133,377 | A | 7/1992 | Truxillo |
| D329,030 | S | 9/1992 | Myers |
| D329,835 | S | 9/1992 | Scheinrock |
| 5,170,810 | A | 12/1992 | Chapin |
| 5,217,032 | A | 6/1993 | Jobst |
| D339,772 | S | 9/1993 | Hu |
| D346,516 | S | 5/1994 | D'Anna et al. |
| D353,123 | S | 12/1994 | Korona |
| 5,392,802 | A | 2/1995 | Farr et al. |
| D356,532 | S | 3/1995 | Butzman |
| D363,051 | S | 10/1995 | Lanzillo |
| 5,458,394 | A | 10/1995 | Nichols et al. |
| 5,531,238 | A | 7/1996 | Azzarelli et al. |
| 5,642,748 | A | 7/1997 | Obitts |
| 5,694,959 | A | 12/1997 | Hiller et al. |
| 5,716,063 | A | 2/1998 | Doyle et al. |
| 5,882,067 | A | 3/1999 | Carbajal et al. |
| D423,290 | S | 4/2000 | Green |
| D445,143 | S | 7/2001 | Bellows |
| 6,296,263 | B1 | 10/2001 | Schultz et al. |
| 6,371,142 | B1 | 4/2002 | Battiston |
| 6,817,372 | B2 | 11/2004 | Ennals et al. |
| 6,883,529 | B2 | 4/2005 | Kvaternik |
| D510,481 | S | 10/2005 | Hodgson |
| 1,555,038 | A1 | 10/2005 | Thweatt |
| D527,953 | S | 9/2006 | Le Gal |

TRAY FOR A WALKER

RELATED APPLICATIONS

This application is a continuation of U.S. application Ser. No. 11/939,824, filed on Nov. 14, 2007, now U.S. Pat. No. 7,712,477 entitled "Tray For A Walker" by McCarthy, Alice.

The entire teachings of the above application are incorporated herein by reference.

BACKGROUND OF THE INVENTION

Individuals that use walkers often have a difficult time carrying items, especially food and drink, from one location to another. Trays for use with walkers are often difficult for these individuals to fold or attach to the walker, especially if the individual has arthritis.

Additionally, it is often difficult for an individual to use a walker while the tray is attached to the walker. Many times the tray impedes the use of the walker, and as a result, forces the user to remove the tray and reattach it every time they need it. Additionally, many walkers cannot be folded away when the tray is attached.

Hence, a need exists for a tray that is easy to use for a person who needs assistance with walking, especially when the person also has arthritis. A further need exists for a tray that can be folded out of the way, without being fully removed, when the walker is in use, but not the tray. Yet another need exists to be able to fold the tray and the walker in a storage position, without have to remove the tray from the walker.

SUMMARY OF THE INVENTION

The present invention relates to a tray for use with a walker. The walker with which the tray is used has a first support and a second support. Each support has an essentially vertical front leg and an essentially vertical back leg, wherein the front and back legs are joined at a top portion by a handle. The legs are also joined at a lower portion by an essentially horizontal support member. The walker further includes a cross bar that connects the first and second supports at an upper point of each front leg. The tray includes a generally rigid tray base having an essentially rectangular shape with a front long side, a back long side, a first short side and a second short side. The tray has a length that extends to or past the essentially horizontal support members. The tray further includes a ridge extending along the sides of the tray, wherein the ridge has a height of at least about a ½ inch (e.g., between about a ½ inch and about 1½ inches), and a strap having a hook and loop fastener wherein the strap is positioned at or near the back long end. The ridge, in an embodiment, folds down on the short sides, the long sides, or both. The tray of the present invention further embodies a first hinge and a second hinge. The first and second hinges are positioned, when the tray is in use, at or near the front leg of the first and second support, respectively. The length of the tray is greater that the distance between the support members of the first and second support; and the width of the tray is less than the length of the support member of the first support or second support. The length of the tray allows the tray to rest on the support members of the walker. In an embodiment, the tray has a length between about 17 and about 27 inches (e.g., between about 20 and about 24 inches). The width of the tray allows the tray to fit between the legs of the walker. In yet another embodiment, the tray has a width between about 7 and about 15 inches (e.g., between about 9 and about 13 inches). The hinge, in one aspect, includes a loop, rope, or a tie. When the walker is in use, the tray of the present invention is folded up by wrapping the strap around the cross bar of the walker and engaging the hook and loop fastener. In an aspect, the tray base, the ridge or both is made from the same material or from different material. They can be made in a single piece, or multiple pieces. Materials from which the tray base, the ridge or both can be made include metal, stainless steal, plastic, wood, hardboard (e.g., Masonite), composites, and any combination thereof.

The present invention further includes methods for using the tray, as described herein. In an embodiment, the methods pertain to carrying an item from a first location to a second location using the walker, as described herein. The methods include placing the item on the tray of the present invention, and walking from the first location to the second location using said walker. The methods also include folding down the tray (e.g., prior to use) by disengaging the hook and loop fastener. Additionally, the methods relate to folding up the tray (e.g., after use) and engaging the hook and loop fastener, and optionally folding in the legs of the walker. Engaging the hook and loop fastener further includes wrapping the strap round the cross bar or otherwise attaching the hook and loop fastener to the cross bar.

The present invention also relates to systems and kits for carrying an item from one location to another using a walker. The systems and kits include the walker, as described herein, and the tray of the present invention. The system can further include an adapter (e.g., slider, glider or a roller) for allowing a stationary walker to slide across the floor.

Several advantages of the present invention exist. An individual can easily use the tray of the present invention even if the individual has arthritis. The hook and loop fastener is easy to manipulate and allows the individual to wrap the fastener around the cross bar to fold the tray upright. Additionally, when the user wants to use the tray, all the user has to do is release or disengage the hook and loop fastener, and the tray folds down. When the tray is in the upright position, the position of the folded tray does not impede the user's ability to also use and/or fold away the walker. Hence, an advantage of the tray is that the user does not need to attach and/or reattach the tray.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
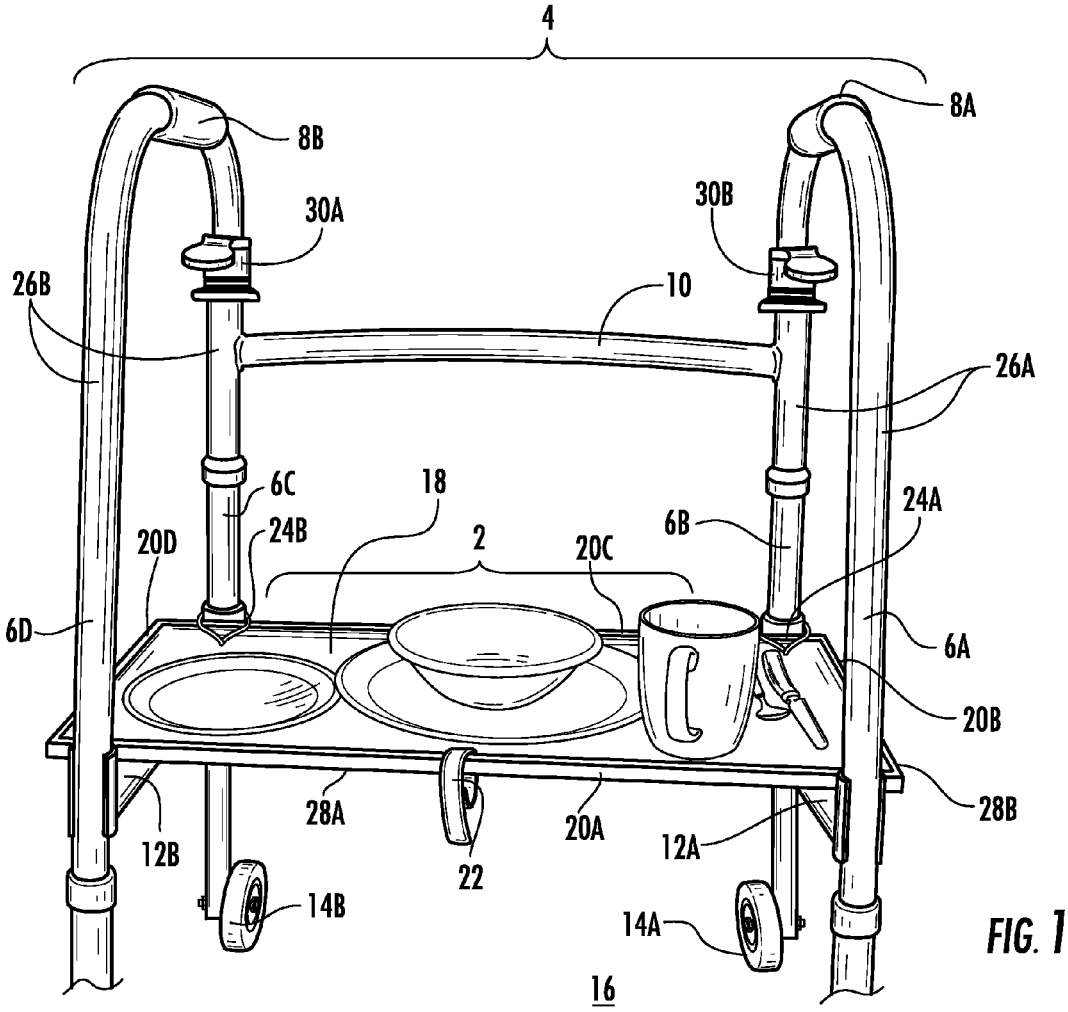
FIG. 1 is a drawing of a perspective view of the tray of the present invention when in use with a walker to carry food items.

The present invention relates to a tray to be used with a walker, as shown in FIG. 1. The tray of the present invention allows the user to bring items from one location to another, and is designed so that when the tray is not in use, it can be folded up and away without interfering with the use of the walker. In particular, when the tray is folded upright, the user can utilize the walker to assist him/her with walking, and the walker can be folded away as well.

Figure 2:
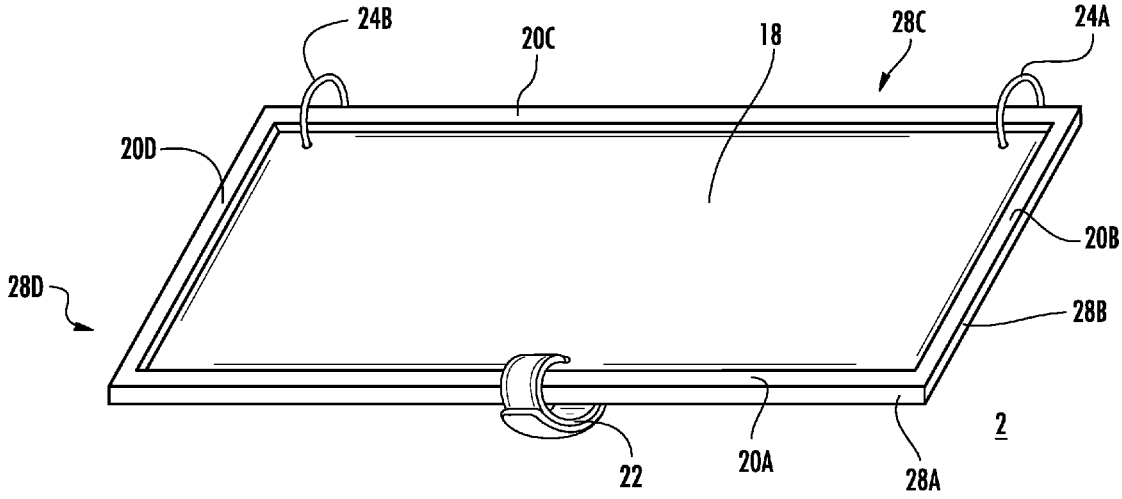
FIG. 2 is a drawing of a perspective view of the tray of the present invention.

Referring to FIGS. 1 and 2, the tray has a generally rigid, rectangular base. Tray base 18 has two long sides, front long side 28C and back long side 28A, and two short sides, sides 28B and 28D. The tray has a ridge that is comprised of ridge members, 20A-D, that extend along each side of tray base 18. Tray base 18 has a length that is at or extends beyond the distance between support members 12A and 12B of walker 4. The length of the tray base allows the base to rest on the support members when in use, and in one aspect, depends on the distance between the support members of the walker. In an embodiment, the length of the tray ranges between about 17 and about 27 inches (e.g., between about 20 and about 24 inches). The width of the tray base (e.g., the length of short sides 28B and 28D), in an embodiment, is less than the distance between the legs 6A and 6B (or 6C and 6D). Having a width that is less than the distance between the legs allows, in part, for the tray to fit within the legs when in use, and also allows the tray to be folded away so that it does not interfere with the use of the walker. As such, in one aspect, the width of the tray ranges between about 7 and about 15 inches (e.g., between about 9 and about 13 inches).

The walker with which the tray is used has two supports, supports 26A and 26B. Each support has two legs. Support 26A has legs 6A and 6B, and support 26B has legs 6C and 6D. Legs 6A and 6B are connected by support member 12A, while legs 6C and 6D are connected by support member 12B. The legs of the supports are basically cylindrical in shape, but can also be rectangular, or square. The legs can be of any shape so long as they provide support for the walker. The bottom portion of legs 6A-B has an adjustable mechanism to adjust the height of the walker. The mechanism has a pin and a series of openings along the length of the bottom portion of each leg. The pin can be pushed in on all legs, to thereby allow the legs to slide up and down to the desired position. When at the desired height, the pin is released through one of the openings and secured in place. The adjustable mechanism can be used to adjust the height of the tray when the tray is in use (e.g., when sitting and eating, the tray can be raised or lowered).

The legs further include four wheels at the bottom of each leg. Wheels 14A and 14B are shown in FIG. 1, and the other two are not shown. The present invention can be used with a walker with and without wheels. In an embodiment, the tray can be sold with an adapter (e.g., a glider, slider or sleeve) that attaches to walkers without wheels. The sliders or sleeves allow the walker to more easily slide or roll across the floor.

Additionally, the legs have a release lever positioned in the top portion of the front legs, legs 6B and 6C. The release levers 30A and 30B allow the back legs, legs 6A and 6C, to be folded inward for storage. The lever is locked in place when the walker is in use, and released when the legs of the walker are folded inward. When the walker and tray are not in use, the user can fold the tray upright and fold the legs inward. When the walker is folded upright, e.g., to be put away, the release levers can be released to allow the legs to fold inward (e.g., see FIG. 3). An example of such a walker is Invacare Model # 6291-A (Invacare Corporation, Ohio). The presence of the tray does not prevent the user's ability to fully or partially fold the back legs inward to store the walker/tray assembly. In an embodiment, the legs can be folded at least about 50% (e.g., 60%, 70%, 75%, 80%, 85%, 90%, or 95) of the range the legs would otherwise fold inward if the tray was not attached. In order to fold the tray, the user simply lifts the tray essentially upright, wraps strap 22 around cross bar 10 and engages the hook and loop fastener. To fold the tray down, the user disengages the hook and loop fastener and the tray folds down into place by resting on the support members. An individual with arthritis can engage and disengage the strap/hook and loop configuration as needed without the need for a lot of manipulation with their fingers.

The support members are essentially horizontal members that attach to a lower portion of the leg and extend there between. In an embodiment, the support member attaches to a point on the leg that is below the midpoint of the legs. Support members 12A and 12B act as a support for the legs, but also as a support for the tray when the tray is in use. The legs of the support are also connected by the handle at the top end or portion of the legs. Support members 12A and 12B are bars having an attachment adapted to receive the cylindrical shape of the legs. The support members can be bars, rods, prisms, or of any shape so long as they provide support to the walker and/or to the tray, when in use. Preferably the support members have a flat surface for all or a portion of the member at which the tray comes into contact to provide for a more stable surface.

Legs 6A and 6B are connected by handle 8A, while legs 6C and 6D are connected at the top by handle 8B. Although the top of the legs and the handles are continuous for some embodiments, they can be made from separate pieces in other embodiments.

Handles 8A and 8B further include foam grips wrapped around them for comfort. The handles can be connected at the top end or to a top portion of the legs. The handles and/or grips can be shaped to receive a user's hand and/or ergonomically designed.

Cross bar 10 connects supports 26A and 26B. Specifically, cross bar 10 connects to legs 6B and 6C at an upper portion of the legs (e.g., at a point above the mid-point of the legs and preferably at a point in the top ⅓ portion of the legs). The cross bar in this embodiment is cylindrical, but can also be a bar, or prism. The cross bar can be of any shape so long as it acts to stabilize the supports or front legs.

As shown in FIG. 2, the tray further includes a ridge that extends along the sides of the tray base. Ridge members 20A-D make up the ridge of the tray. The ridge has a height and width to prevent items, e.g., dishes and glasses having food or beverages, from falling off the tray. In an embodiment, the ridge has a height of at least about ½ to about 1½ inches. The width of the ridge also can, in an embodiment, prevent items from falling or spilling. The width of the ridge ranges from a distance between about ¼ inch and about 1 inch. Although the ridge of the tray extends along all sides of the tray base, the hinge design prevents the ridge from interfering with the folding up of the tray or the walker. In an embodiment, one or more ridge members can fold down when the tray is not in use. A hinge can be used to allow the ridge member to fold up and down. In one embodiment, the ridge members located along the short sides of the tray can fold up and down. In another embodiment, all four ridge members fold up and down.

The tray base and the ridge can be made from the same or different material, or from a singe piece or multiple pieces. The tray base or the ridge can be made from plastic, wood, metal, stainless steel, hardboard (e.g., Masonite), composites, or any combination thereof. Other materials that are known in the art or developed in the future can be used. Preferably, the tray base and ridge are made from a material that is easy to clean. The ridge and tray base can be made as a single, continuous piece, e.g., of molded plastic. The surface of the tray base and/or ridge members is preferably smooth.

The present invention further includes strap 22 having a hook and loop fastener (e.g., a Velcro® type fastener). Strap 22 is positioned at a point at or near long side 28A. In this case, tray base 18 has an opening to receive strap 22 at the point adjacent to ridge member 20A. The strap can be located at any point along ridge member 20A, and can be attached directly to or adjacent to the ridge member or long side. The strap can be attached to the tray using adhesive, a fastener, an opening to receive the strap, or any method known in the art for attaching a strap to a tray. In this embodiment, the strap is long enough to wrap around cross bar 10 when the tray is folded up. The fastener can have a length that is long enough to attach or otherwise secure to the cross bar. In an embodiment, the strap has a length between about 6 inches and about 12 inches. In addition to wrapping around cross bar 10, fastener 22 can be a shorter piece of material in which one end (e.g., the hook end) attaches to the ridge and the other end (e.g., the loop end) attaches to the cross bar. In an embodiment, one or more fasteners can be used to secure the tray to the cross bar. In this case, the fastener can have a length ranging from about ¼ inch to about 6 inches. Straps and/or hook and loop fasteners that are known in the art or developed in the future can be used with the present invention. In an embodiment, the strap is made from webbing to which the hook end and loop end is sewn.

Tray 2 further includes hinge 24A and 24B. In an embodiment, the hinge is a loop that is positioned on the tray base at, or near ridge member 20C, such that when the tray is in use, the loop wraps around on of the front legs, either leg 6B or 6C. In another embodiment, the hinge can be a tie or rope having two ends that wrap around one of the front legs and can be tied together. In this embodiment, the hinge can be untied and the tray completely removed, e.g., for cleaning or to be placed in a dishwasher. Preferably, the loop or tie loosely fits around the front leg. A loose fit allows the tray to be folded up and down with ease, and allows room for the ridge when the tray is folded upright and secured to cross bar 10 by strap 22 using the hook and loop fastener. The hinge, in an aspect, is made from plastic or fabric. The hinge can be made from any material now known or later developed that allows the hinge to be formed by a loop or as a tie.

Figure 3:
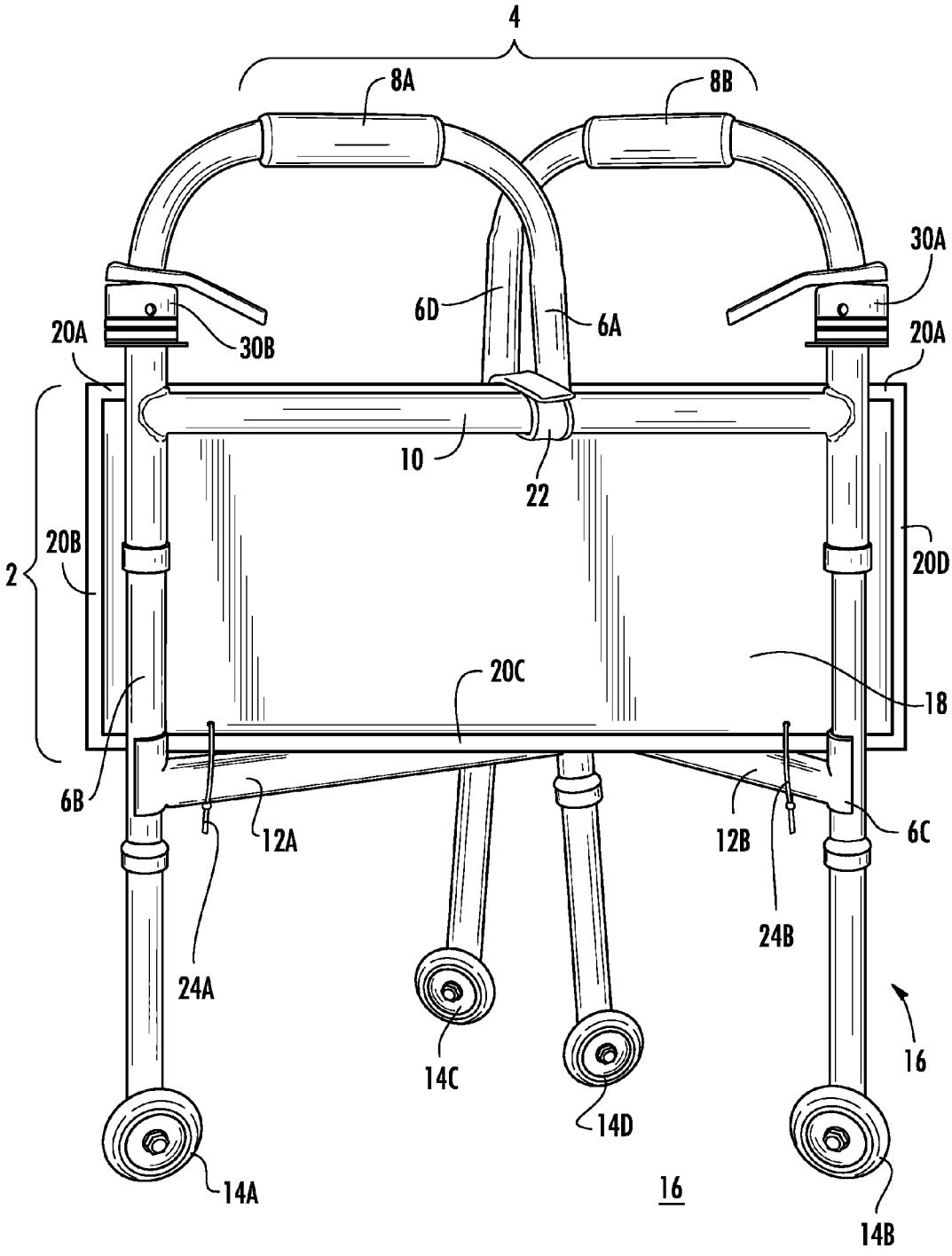
FIG. 3 is a drawing of a front view of the tray when the tray is folded upright, and when the walker's legs are folded inward.

In FIG. 3, tray 2 is folded upright, and legs 6B and 6C of walker 4 are folded inward. To accomplish the folding of the tray, the user simply lifts the tray and engages or secures the hook and loop fastener so that strap 22 is wrapped around cross bar 10. In an embodiment, the user simply engages the hook end with the loop end of the fastener to fold the tray. A person with arthritis can easily fold the tray up and down by engaging or disengaging the fastener. When the tray is folded upright and the fastener engaged, the user can utilize the walker without any interference from tray 2. Since the tray is folded out of the way, the user's legs do not hit the tray when the user is walking with assistance of the walker. Additionally, FIG. 3 shows that the back legs of the walker have been folded inward for storage. The tray does not impede the inward folding, at least partially or fully, of the legs of the walker. When the walker is in this position, the tray is folded relatively flat and in an essentially vertical position. The tray does not need to be removed, which aids the user, especially one with mobility issues, by minimizing the amount of movement need to operate the tray along with the walker. The tray advantageously does not need to be removed and reattached every time the user folds the back legs inward. The design allows flexibility and ease of use.

The present invention further includes methods of use the tray, as described herein. The methods include placing one or more items to be moved from one location to another location, and with the assistance of the walker, walking to the desired location. Prior to use the tray, the method further includes disengaging the hook and loop fastener and folding down the tray (e.g., allow the tray to rest on the support members). When the user is done using the tray, the methods for storing the tray include folding the tray upright and engaging the hook and loop fastener. In an embodiment, the hook and loop fastener is engaged by wrapping the fastener around the cross bar and engaging the ends of the fastener.

Systems and kits are included in the present invention. The system or kit of the present invention includes the tray and walker, as described herein. The system or kit further includes an adapter to be used with the walker. Examples of an adapter include a slider, glider, rollers which adapt a stationary walker to roll or slide on the floor.

Exemplification

The tray base, as shown in FIGS. 1-3, of the present invention was constructed from a piece of wood measuring 22½ inches by 11 inches by ¼ inch. The long ridge members were made from pieces of wood measuring 11½ inches by 1 inch by 1 inch, and glued in place. The short ridge members were constructed from a piece of wood measuring 11 inches by 1 inch by 1 inch. An opening on one side of the tray was made adjacent to a long ridge member, to receive a strap fastener that measures about 12½ inches with a hook and loop on each end. The strap was inserted into the opening and fastened to the tray base. The hinges were made from plastic ties and were each inserted into an opening next to the other long ridge member of the tray. The tray was attached to the walker by wrapping a plastic tie around each the front leg of the walker and securing the ends. The tray was used in the methods as described herein to bring food items from the kitchen to the eating area, and when finished back to the kitchen. The tray was easily manipulated by a user having arthritis. The user was able to engage and disengage the hook and loop fastener.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for carrying an item from a first location to a second location using a walker, said walker having a first support and a second support, each support having an essentially vertical front leg and an essentially vertical back leg, wherein the front and back legs are joined at a top portion by a handle and at a lower portion by an essentially horizontal support member; said walker further including a cross bar that connects the first and second supports at an upper point of each front leg; the method comprises:

a. placing the item on a tray that comprises:

i. a generally rigid tray base having an essentially rectangular shape with a front long side, a back long side, a first short side and a second short side;

ii. a ridge extending upward and along the sides of the tray, wherein the ridge has a height of at least about ½ inch;

iii. a strap having a hook and loop fastener wherein the strap is positioned at or near the back long side; and iv. a first hinge and a second hinge, wherein the first hinge and the second hinge are positioned at the front long side to wrap around the front legs of the walker respectfully;

wherein a length of the tray is between about 17 and about 27 inches and a width of the tray is between about 7 and about 15 inches and wherein the two short sides of the tray can be placed on and between the essentially horizontal support members of the walker in a use position, and the strap is connectable to the cross member of the walker to hang the tray to the walker in a folding position; and b. walking to the second location using said walker.

2. The method of claim 1, further including folding down the tray by disengaging the hook and loop fastener.

3. The method of claim 1, further including folding up the tray when in use and engaging the hook and loop fastener.

4. The method of claim 3, wherein engaging the hook and loop fastener further includes wrapping the strap round the cross bar or attaching the hook and loop fastener to the cross bar.

5. The method of claim 1, wherein the tray further includes a hinge that is comprised of a loop or a tie.

6. The method of claim 1, wherein the tray further includes a tray base, or the ridge or both is made from the same material or from different material.

7. The method of claim 6, wherein the tray base, or the ridge or both is made from metal, stainless steel, plastic, wood, hardboard, composites, and any combination thereof.

* * * * *